US009777526B1

(12) United States Patent
Knittel

(10) Patent No.: US 9,777,526 B1
(45) **Date of Patent: *Oct. 3, 2017**

(54) AUTOMATED STORM DOOR CLOSURE SYSTEM

(71) Applicant: Edward C. Knittel, Trenton, TN (US)

(72) Inventor: Edward C. Knittel, Trenton, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/056,194

(22) Filed: Feb. 29, 2016

Related U.S. Application Data

(63) Continuation of application No. 14/171,376, filed on Feb. 3, 2014, now Pat. No. 9,273,505.

(60) Provisional application No. 61/849,860, filed on Feb. 4, 2013.

(51) Int. Cl.

| | |
|---|---|
| ***E05F 3/22*** | (2006.01) |
| ***E05F 1/00*** | (2006.01) |
| ***E05F 1/10*** | (2006.01) |
| ***E05F 3/00*** | (2006.01) |

(52) U.S. Cl.
CPC ..... *E05F 3/222* (2013.01); *E05F 1/008* (2013.01); *E05F 1/105* (2013.01); *E05F 3/00* (2013.01); *E05Y 2201/218* (2013.01); *E05Y 2201/43* (2013.01); *E05Y 2400/20* (2013.01); *E05Y 2900/132* (2013.01)

(58) Field of Classification Search
CPC ..... E06B 5/00; E06B 5/003; E06B 2009/005; E05F 3/22; E05F 3/221; E05F 3/222; E05F 3/223; E05F 3/227; E05F 15/50; E05F 15/53; E05F 15/54; E05F 15/73; E05Y 2201/218
See application file for complete search history.

(56) References Cited

U.S. PATENT DOCUMENTS

| | | | | |
|---|---|---|---|---|
| 5,525,963 | A | 6/1996 | Purssey | |
| 5,592,780 | A | 1/1997 | Checkovich | |
| 5,832,562 | A | 11/1998 | Luca | |
| 6,580,355 | B1 | 6/2003 | Milo | |
| 6,910,302 | B2 * | 6/2005 | Crawford | E05F 5/12 16/49 |

(Continued)

OTHER PUBLICATIONS

Information Disclosure Statement (IDS) Letter Regarding Common Patent Application(s), dated Mar. 8, 2016.

*Primary Examiner* — Katherine Mitchell
*Assistant Examiner* — Catherine A Kelly
(74) *Attorney, Agent, or Firm* — Tillman Wright, PLLC; James D. Wright; David R. Higgins

(57) ABSTRACT

An automated door closure system regulate the release and closure of a door in a door assembly that includes a primary door, a secondary door, and a door frame. The system includes a door closer, a control unit, and an automatic input sensor. The door closer, which is connected between the secondary door and the door frame and includes a cylinder and an operating rod, biases the secondary door toward a closed position. The control unit includes a motive device and a rod catch element. The rod catch element, which may be moved by the motor, is positioned in proximity to the operating rod to adjustably prevent the secondary door from being closed. The automatic input sensor detects a door assembly use condition. The control unit controls the motive device based on the detected condition to move the rod catch element, allowing the door closer to close the secondary door.

21 Claims, 12 Drawing Sheets

(56) References Cited

U.S. PATENT DOCUMENTS

| | | | | |
|---|---|---|---|---|
| 7,216,400 | B2 * | 5/2007 | Hodson | E05F 3/221 16/66 |
| 8,196,259 | B2 * | 6/2012 | Armstrong | E05F 3/02 16/49 |
| 8,474,993 | B2 | 7/2013 | Williamson | |
| 8,661,616 | B1 | 3/2014 | Luca | |
| 9,273,505 | B1 | 3/2016 | Knittel | |
| 2011/0227746 | A1 | 9/2011 | Houser et al. | |
| 2013/0099715 | A1 | 4/2013 | Fuhge | |

* cited by examiner

AUTOMATED STORM DOOR CLOSURE SYSTEM

CROSS-REFERENCE TO RELATED APPLICATION

The present application is a U.S. continuation patent application of, and claims priority under 35 U.S.C. §120 to, U.S. nonprovisional patent application Ser. No. 14/171,376, filed Feb. 3, 2014, which nonprovisional patent application is a U.S. nonprovisional patent application of, and claims priority under 35 U.S.C. §119(e) to, U.S. provisional patent application Ser. No. 61/849,860, filed Feb. 4, 2013 and entitled "AUTOMATED STORM DOOR CLOSER." The foregoing patent applications are expressly incorporated by reference herein in its entirety.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE PRESENT INVENTION

Field of the Present Invention

The present invention relates generally to the automation of a door closer unit, and in particular, to an automated door closure system that holds open and subsequently releases a door for user convenience.

Background

Secondary doors such as storm, security, and screen doors are commonly installed in front of an exterior door to protect the exterior door from weather, to prevent insects from entering the building, and/or for security. Many of the secondary doors currently on the market have a closing device, sometimes referred to herein as a "door closer," to ensure that the door gradually closes when not held open.

One common, inexpensive closing device is a pneumatic door closer that includes a tubular housing, typically in the form of a cylinder, which contains, and operates with the use of, air, fluid, springs, and/or the like to control the closure of a door. These door closers function with an operating rod extending from one end of the cylinder. Such a closure device is typically disposed between the secondary door and the primary exterior door, with the end of the cylinder mounted to the storm door, using a mounting plug and mounting bracket, and the rod extending from the other end of the door closer and connected to the primary door frame. The rod is connected to a piston or spring mechanism inside the cylinder. Opening the secondary door exerts force on the rod, causing it to be withdrawn from the cylinder and causing the piston and/or spring mechanism to compress in the cylinder. When force is released from the rod (i.e., when the user releases the door), the force applied by the spring and/or piston mechanism causes the end rod to be pulled back into the cylinder, causing the door to close. The spring and/or piston mechanism also regulates the speed at which rod is withdrawn into the cylinder (and thus at which the door is allowed to close). In many cases, a valve or the like may be provided to adjust this speed.

The end rod usually includes a locking key that can be used to keep the secondary door open. Conventionally, the locking key is a hardened plate with two angled portions and a central aperture through which the rod passes. With the door open, and the end rod extended from the cylinder, a user can slide the locking key along the rod to a desired position, usually against the end of the cylinder. When the door is released against the locking key such that the two angled portions are each pressed against the end of the cylinder, the edges of the central aperture are forced against the rod and held there by friction, thereby preventing the rod from being withdrawn any further into the cylinder. Because the rod is thus prevented from returning into the cylinder, the door is prevented from closing. To close the door, the locking key is manually adjusted by orienting the locking key to be perpendicular to the rod, thus releasing the tension between the locking key and the cylinder and allowing the locking key to slide easily along the rod once again. With the locking key out of the way, the rod can withdraw into the cylinder once again and the door may be closed.

Unfortunately, keeping a secondary door open thus requires manual action by a user to move the locking key along the end rod. Also, when a door is currently in its open state, the user must manually re-position the locking key in order to close the door. Adjusting the locking key to keep a secondary door open can be an inconvenience for the user. For example, a person carrying items in or out of the house may struggle to open the door and hold onto the items. Furthermore, a person limited in mobility, strength, or height may struggle or not be able to move the locking key. Although various improvements have been made to standard door closers in an attempt to partially automate the "hold open" feature, all such improvements fail to completely automate the "hold open" and release-to-close features. Expensive automatic secondary doors are also available, but these usually require professional installation and are not meant to directly replace the conventional storm door, or screen door.

Accordingly, it is believed that a need exists for an inexpensive, easy to install, and/or otherwise improved closing device which holds open and subsequently closes a secondary door without the need for the user to take additional action. It is believed that one or more of these needs and other needs are addressed by one or more aspects and features of the present invention.

SUMMARY OF THE PRESENT INVENTION

Broadly defined, the present invention according to one aspect is an automated door closure system to regulate the release and closure of a door in a door assembly, the door assembly including a primary door, a secondary door, and a door frame defining a doorway, the system including: a door closer connected between the secondary door and the door frame, the door closer including a cylinder having an operating rod extending from an end thereof, wherein the door closer biases the secondary door toward a closed position in the doorway; a control unit, including a motive device and a rod catch element, wherein the rod catch element is positioned in proximity to the operating rod so as to adjustably prevent the secondary door from being closed, wherein the rod catch element may be moved by the motor; and an automatic input sensor arranged to detect a condition pertaining to the use of the door assembly; wherein the control unit controls operation of the motive device, based on the detected condition, to move the rod catch element, thereby permitting the door closer to close the secondary door.

In a feature of this aspect, the condition is motion in the vicinity of the doorway, wherein the automatic input sensor is a motion detector, and wherein the control unit controls operation of the motive device based on the detection of motion in the doorway. In further features, after motion is detected in the doorway, the control unit controls the motive device to release the rod catch element from the operating rod in response to no further motion being detected in the doorway; the control unit controls the motive device to release the rod catch element from the operating rod a predetermined period of time after the most recent motion was detected in the doorway; and/or the motion detector is integrated into the control unit.

In another feature of this aspect, the condition is a position of a primary door in the doorway, wherein the automatic input sensor is a door position sensor, and wherein the control unit controls operation of the motive device based on the detection of the position of the primary door in the doorway. In further features, the condition includes a sequence of, first, the detection of the primary door being open, and, second, the detection of the primary door being closed, and wherein upon the occurrence of the sequence, the control unit controls the motive device to release the rod catch element from the operating rod; the door position sensor is housed in a unit that is physical separate from the control unit; the door position sensor communicates wirelessly with the control unit; and/or the door position sensor communicates via wired connection with the control unit.

In another feature of this aspect, the control unit includes a timer that delays operation of the rod catch element for a predetermined period of time after the automatic input sensor detects the condition pertaining to the operation of the secondary door. In a further feature, the motive device operates to release the rod catch element, based on the timer, from the operating rod of the door closer, thereby allowing the door closer to bias the secondary door toward the closed position in the doorway.

In another feature of this aspect, the motive device is a motor, and the motor drives a motor shaft that moves the rod catch element via a mechanical linkage. In further features, the operating rod passes through the rod catch element, the mechanical linkage includes a cam that is rotated by movement of the motor shaft, and when the cam is rotated into a locking position, the rod catch element is tilted relative to the operating rod, thereby preventing the operating rod from moving further relative to the rod catch element; when the secondary door is open and the cam is rotated from the locking position into an unlocking position, the rod catch element becomes untilted relative to the operating rod, thereby permitting the operating rod to move relative to the rod catch element and thus permitting the secondary door to close; and/or the operating rod passes through the rod catch element, the mechanical linkage includes an inclined surface that is moved by movement of the motor shaft, and when the inclined surface is forced against a corresponding surface of the rod catch element, the rod catch element is moved from a tilted position, relative to the operating rod, to an untilted position, thereby permitting the operating rod to move relative to the rod catch element and thus permitting the secondary door to close.

In another feature of this aspect, the operating rod is permitted to move freely, relative to the rod catch element, when the secondary door is opened, but is automatically and temporarily prevented from moving freely, relative to the rod catch element, once the secondary door is released by a user. In a further feature, the operating rod is prevented from moving freely until the motive device effectuates movement of the rod catch element, and the motive device effectuates movement of the rod catch element based upon the detection, by the automatic input sensor, of the condition pertaining to the use of the door assembly.

Broadly defined, the present invention according to another aspect is an automated door closure system to regulate the release and closure of a door in a door assembly, the door assembly including a primary door, a secondary door, and a door frame defining a doorway, the system including: a door closer connected between the secondary door and the door frame, the door closer including a cylinder having an operating rod extending from an end thereof, wherein the door closer biases the secondary door toward a closed position in the doorway; a control unit, including a motive device and a rod catch element, wherein the rod catch element is positioned in proximity to the operating rod so as to adjustably prevent the secondary door from being closed, wherein the rod catch element may be moved by the motor, such that when the secondary door is pulled open by a user, the operating rod is allowed to move freely relative to the rod catch element, thereby permitting the secondary door to be opened, when the secondary door is released by the user, the rod catch element is biased to move into position against the operating rod, thereby preventing the secondary door from being closed, and thereafter, the control unit controls operation of the motive device to move the rod catch element away from the operating rod, thereby permitting the operating rod to move freely relative to the rod catch element such that the door closer can bias the secondary door closed.

Broadly defined, the present invention according to another aspect is an automated door closure system to regulate the release and closure of a door in a door assembly, the door assembly including a primary door, a secondary door, and a door frame defining a doorway, the system including: a door closer for connection between the secondary door and the door frame, the door closer including a cylinder, an operating rod extending from an end of the cylinder, and a main spring within the cylinder to bias the secondary door toward a closed position in the doorway; and a control unit, including: a housing defining an interior, a motor connected to a power source and having a motor shaft extending therefrom, a rod catch element positioned along the operating rod such that the operating rod passes through the rod catch element, a primary door sensor to monitor the position of the primary door, a reed switch, a magnet to actuate the reed switch, a cam assembly, including a lever having a first end that engages the washer and a second end that engages the motor shaft, a pivot connector, and a spring that biases the first end of the lever, and a circuit board having control circuitry thereon; wherein the motor moves the motor shaft, under control of the control circuitry on the circuit board and in response to a signal from the primary door sensor pertaining to the position of the primary door, to rotate the cam assembly such that the first lever end engages the rod catch element to release the rod catch element from the operating rod, thereby allowing the operating rod to move freely relative to the rod catch element and allowing the secondary door to close Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further features, embodiments, and advantages of the present invention will become apparent from the following detailed description with reference to the drawings, wherein.

DETAILED DESCRIPTION

Figure 1:
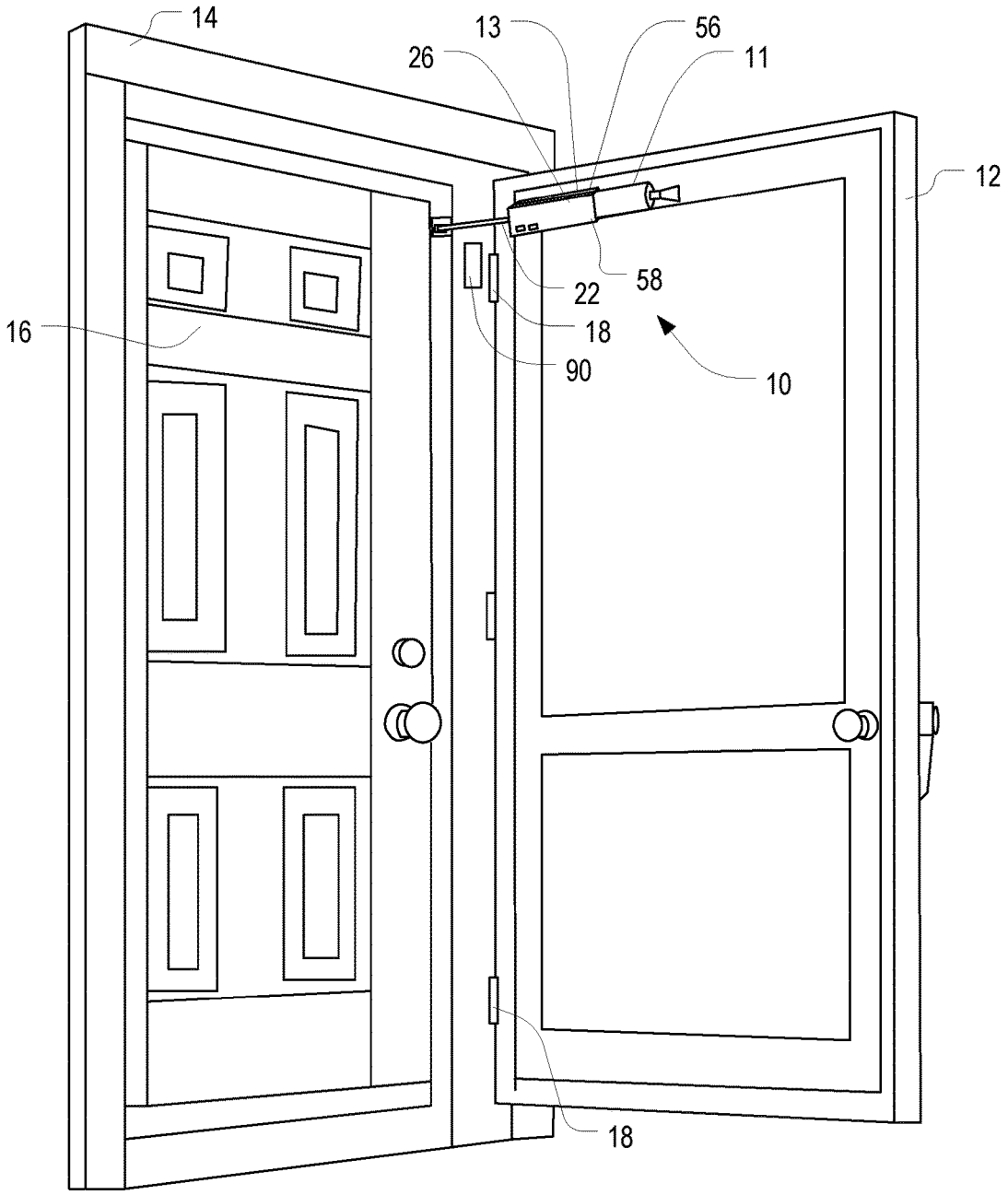
FIG. 1 is a perspective view of an automated door closure system attached to a secondary door in accordance with one or more preferred embodiments of the present invention, wherein the secondary door is in an open state.

As a preliminary matter, it will readily be understood by one having ordinary skill in the relevant art ("Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers," "a picnic basket having crackers without cheese," and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, in which like numerals represent like components throughout the several views, one or more preferred embodiments of the present invention are next described. The following description of one or more preferred embodiment(s) is merely exemplary in nature and is in no way intended to limit the invention, its application, or uses.

The automated door closure system 10 serves as an automation device or mechanism for holding and closing a secondary door, such as a storm door, a screen door, or a security door. FIG. 1 is a perspective view of an automated door closure system 10 attached to a secondary door 12 in accordance with one or more preferred embodiments of the present invention, wherein the secondary door 12 is in an open state. As shown therein, a typical installation environment for the automated door closure system 10 includes a door frame 14, a primary door 16, and a secondary door 12. Notably, as used herein, the term "door frame" is usually used to refer generally to the frame onto which the primary door 16 is attached, without regard to the individual elements of such a door frame. The primary door 16 is hingedly connected to the door frame 14 via a first plurality of hinges 17; the secondary door 12 is hingedly connected to the door frame 14 via a second plurality of hinges 18; and the automated door closure system 10 is installed on, and controls the operation of, the secondary door 12.

It will be appreciated that in some embodiments, the automated door closure system 10 may be attached to, and may control, a primary door 16 instead of a secondary door 12. However, to avoid confusion, it will generally be described herein with regard to the control of a secondary door 12 rather than a primary door 16.

Figure 2:
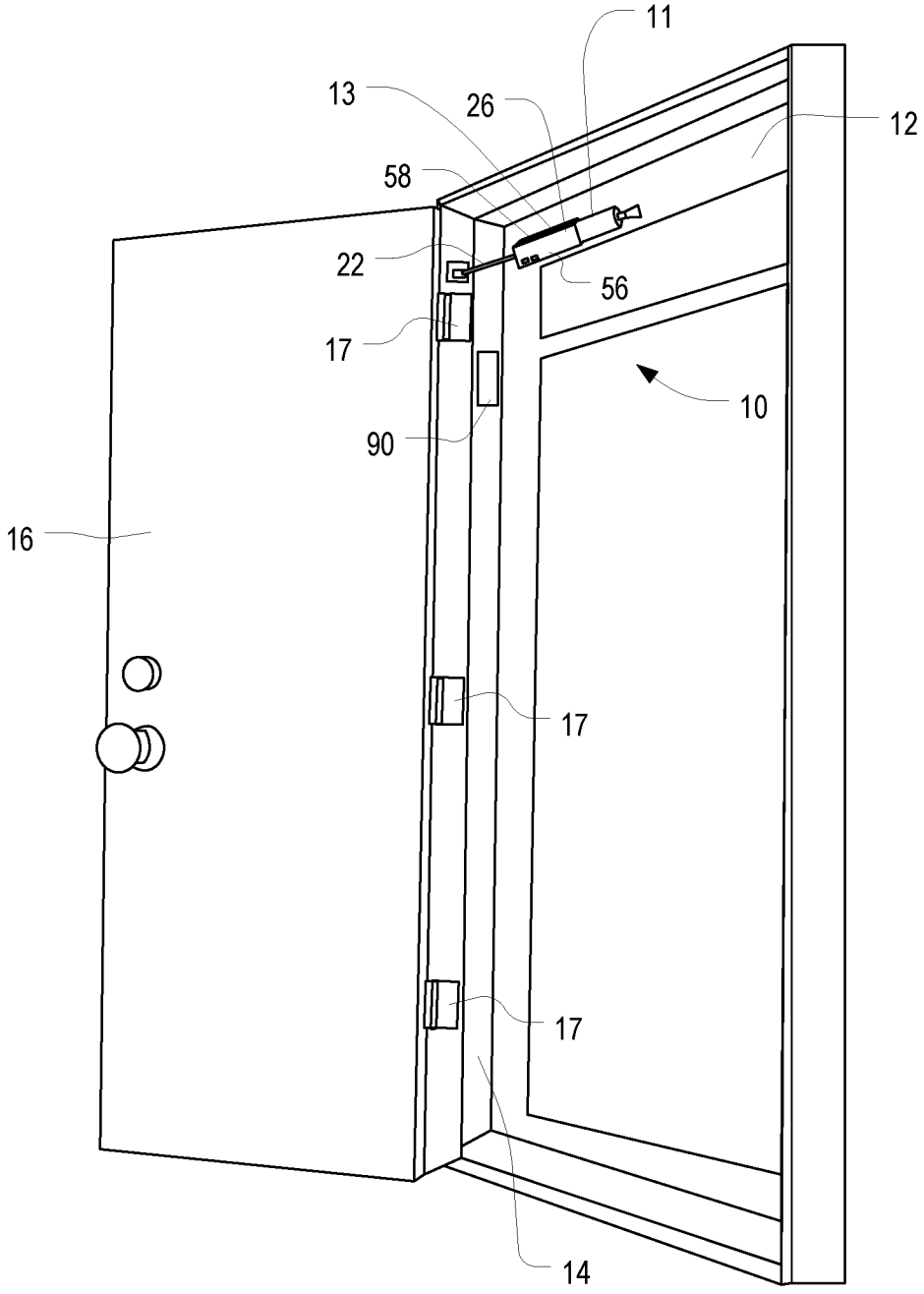
FIG. 2, which is a perspective view of the automated door closure system of FIG. 1, shown attached to a secondary door that is in a closed state.

Referring again to FIG. 1, one preferred embodiment of the automated door closure system 10 includes a door closer 11 and a control unit 13. The door closer 11, which conventionally may serve to prevent the secondary door 12 from slamming shut, to hold the secondary door 12 open, or the like, is connected to the door frame 14 via an operating shaft or rod 22, and is connected to the secondary door 12 via a mounting bracket. This arrangement, standard on many storm doors and other secondary doors, is also shown in FIG. 2, which is a perspective view of the automated door closure system 10 of FIG. 1, shown attached to a secondary door 12 that is in a closed state. The automated door closure system 10 is biased so as to cause the secondary door 12 to swing closed when opened and then released. As described below, the automated door closure system 10 provides an effective way to regulate the release and closure of the secondary door 12.

As shown in FIG. 1, the system 10 preferably also includes a sensor subsystem, including one or more sensor devices. Depending upon the implementation, such sensor devices may be physically incorporated in the control unit 13 or they may be physically separate from the control unit 13 but in communication with the control unit 13. Various sensor devices that may be utilized include position sensors, motion sensors, light sensors, pressure sensors, and the like. In the system 10 illustrated in FIGS. 1 and 2, one sensor device that is provided is a remotely-mounted door position sensor 90 that communicates information about the position of the primary door 16 to the control unit 13, and another sensor device that is provided is a motion sensor 88 (described further below) that is incorporated into the control unit 13 and communicates information about the presence of a user in the doorway or movement of the secondary door 12, but it will be appreciated that other sensor devices may alternatively or additionally be utilized.

Figure 3:
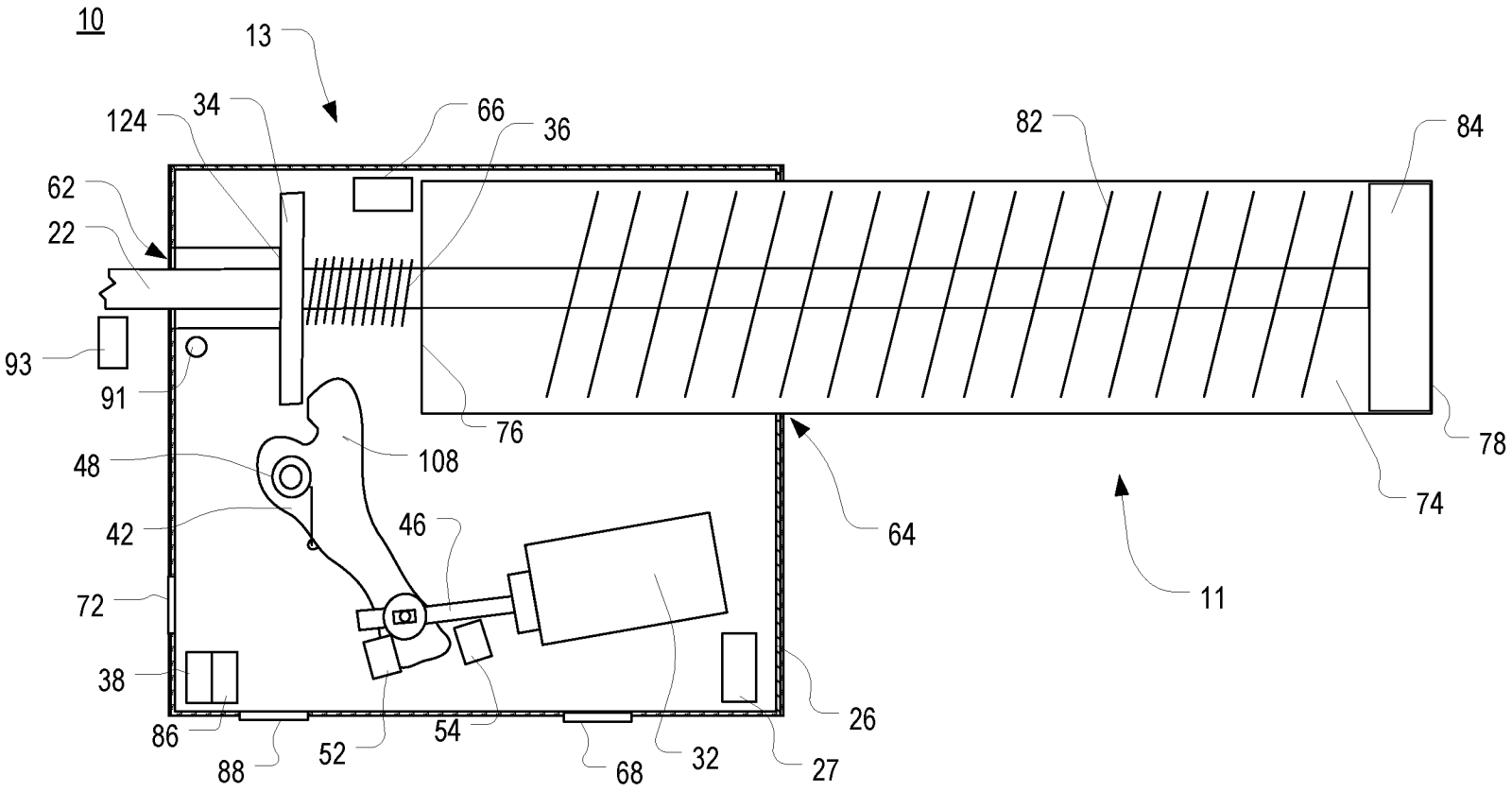
FIG. 3 is a front cross-sectional view of portions of the automated door closure system of FIG. 1, wherein the secondary door is in a closed state.

FIG. 3 is a front cross-sectional view of portions of the automated door closure system 10 of FIG. 1, wherein the secondary door 12 is in a closed state. As shown in FIG. 3, the control unit 13 includes a casing or housing 26, which in some embodiments may be tubular, in which are arranged portions of the door closer 11, a motor 32, a rod catch element 34, a rod catch spring 36, portions of the sensor subsystem (connected via an electrical connector 38), a cam assembly 42 connected to the motor 32 by a motor shaft 46, a pivot connector 48 to connect the cam assembly 42 to the casing 26, a power source 27, a forward limit switch 52, and a reverse limit switch 54. These elements will be described in some detail hereinbelow.

The rod catch element 34, which may, in various embodiments, be a locking key, a washer, or some other structure, is disposed adjacent the operating rod 22. In the illustrated embodiment, the rod catch element 34 is a washer. Like a conventional door closer locking key, the rod catch element 34 may be manipulated to prevent the rod 22 from moving relative to the rod catch element 34, such as by forcing the rod catch element 34 against the rod 22 so as to frictionally hold it in place. The rod catch element 34 is manipulated using the cam assembly 42, which is operated by the motor 32 via the motor shaft 46. In particular, the motor shaft 46 is driven in or out by the motor 32 so as to rotate the cam assembly 42 about the pivot connector 48. The motor 32 may be any electromechanical motive device which can cause the motor shaft 46 to move forward or backward so as to rotate the cam assembly 42. These devices may include commonly known motors such as gear motors, stepper motors, servo motors and the like as well as switch devices such as electromechanical solenoids.

As shown in FIGS. 1 and 2, the casing 26 includes a front half 56 and a back half 58 defining an interior. The halves 56,58 are shaped such when closed they interlock and couple together to provide a housing for the various components therein. A variety of structures may be used to interlock or otherwise couple the two halves 56,58. The front or back halves 56,58 may be formed from plastic, nylon or other suitable material to house and hold the component of the automated door closure system 10 in position.

The housing or casing 26 further includes a first opening 62 through which the operating rod 22 passes, a second opening 64 through which the door closer 11 extends, a rod catch stop 66, slots 49 (illustrated in FIG. 8) to receive and align the pivot connector 48, a motor mounting clip (not shown) located under the motor 32, a series of primary controls 68, and sensor subsystem controls 72. The rod catch stop 66 functions to help secure the door closer 11 within the casing 26 and to limit the movement of the rod catch element 34 along the operating rod 22. As will be further described hereinbelow, the series of primary controls 68 and/or sensor subsystem controls 72 on the casing 26 permit a user to adjust the automated door closure system 10. In a further instance, the series of primary controls 68 and/or sensor subsystem controls 72 permit a user to turn the automated door closure system 10 on or off. In yet a further instance, the series of primary controls 68 and/or sensor subsystem controls 72 permit a user to delay the closure of the secondary door 12.

Some or all of the parts of the door closer 11 in the automated door closure system 10 may, in at least some embodiments, be of conventional design. As is well known, such a door closer 11 typically includes a cylinder 74 in which are disposed a main spring 82 (or compression hydraulic system) and piston head 84. The cylinder 74 has a first end 76 and a second end 78. The operating rod 22 is attached to the cylinder 74 so as to project partly outward from the first end 76 of the cylinder 74. The main spring 82 (or compression hydraulic system) and piston head 84 serve as a biasing means for the operating rod 22 which in turn biases the secondary door 12 toward the closed position when the operating rod 22 is connected to the door frame 14.

The sensor subsystem includes a circuit board 86, a reed switch 91, and a magnet 93, the latter of which engages the reed switch 91. The circuit board 86 may support a microcontroller, a microprocessor, or the like, and may include a clock and additional circuitry components. The reed switch 91 contains a pair of flexible and magnetizable reeds. The reeds of the reed switch 91 are separated by a gap when the reed switch 91 is open. The remotely mounted door position sensor 90, the motion sensor 88, and the reed switch 91 signal information about the positions of the doors 16,12 and/or presence of a user in the doorway, respectively, to the circuit board 86. In at least some embodiments, only one of the sensors, such as the primary door sensor 90 or the motion sensor 88, along with the reed switch 91, is used to signal the circuit board 86. In other embodiments, any combination of a variety of sensors along with the reed switch 91 may be used to signal the circuit board 86. The circuit board 86 is electrically connected to the forward limit switch 52 and the reverse limit switch 54. The series of primary controls and/or sensor subsystem controls 68,72 on the casing 26 connect to the circuit board 86 and the motor 32 to turn the automated door closure system 10 on or off, sense the location of the primary and secondary doors 12,16, set the automated door closure system 10 to a manual mode, and/or set a time delay for the automated door closure system 10. In some embodiments, the series of primary controls and/or sensor subsystem controls 68,72 also contain warning beeper circuitry used to warn the user the secondary door 12 is about to close or is closing.

Figure 4:
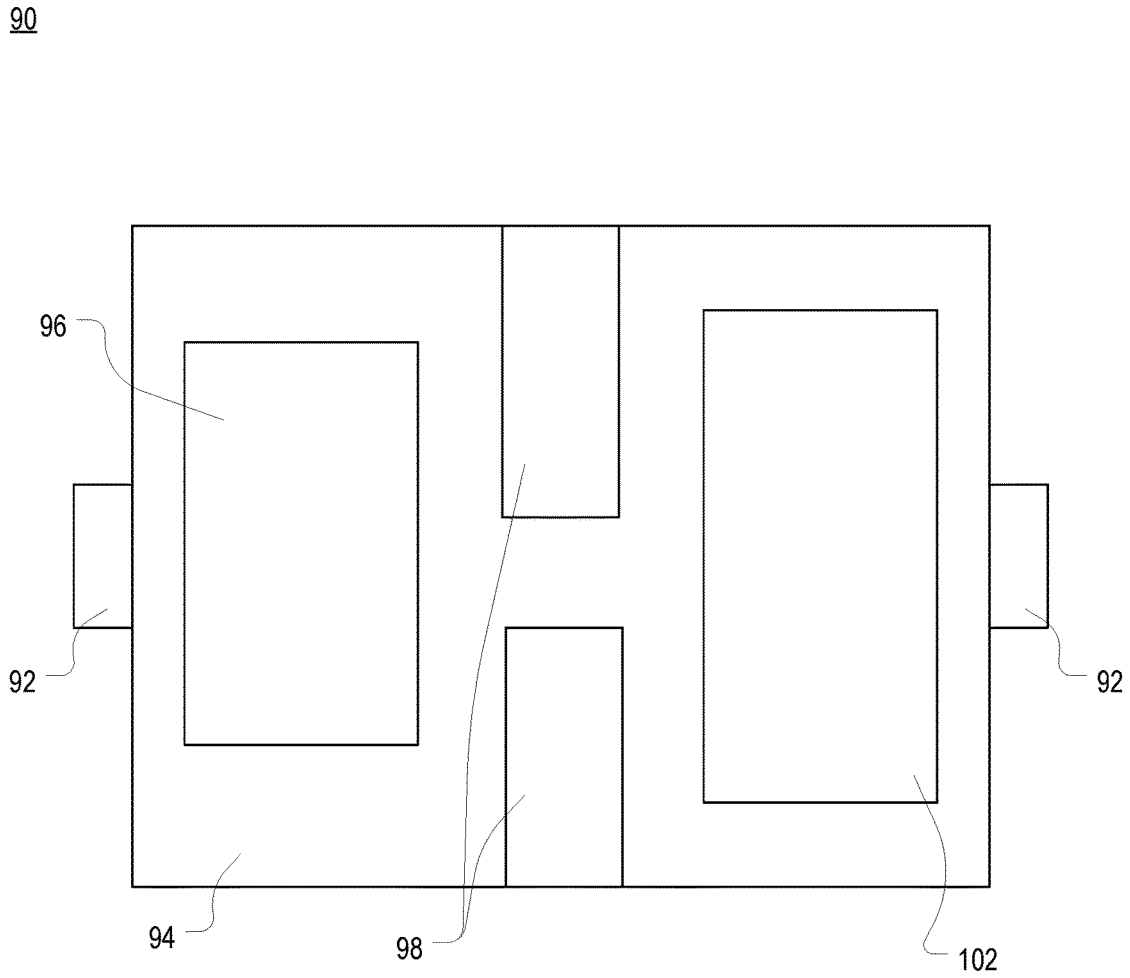
FIG. 4 is a schematic view of the remotely-mounted door position sensor of FIGS. 1 and 2.

FIG. 4 is a schematic view of the remotely-mounted door position sensor 90 of FIGS. 1 and 2. As shown in FIG. 4, the remotely-mounted door position sensor 90 is mounted adjacent the primary door 16 so as to monitor the open and closed state of the door 16. The remotely-mounted door position sensor 90 includes a base-plate 94, at least one tab 92 to mount the remotely-mounted door position sensor 90 to the door frame 14, a power source 96 such as a battery, a door position sensor switch 98, and an electronic circuit board 102. A variety of structures may be used to mount the remotely-mounted door position sensor 90. The power source 96, sensor switch 98 and electronic circuit board 102 are mounted on the base-plate 94. The electronic circuit board 102 includes a signal unit to communicate with a receiver on a circuit board 86 contained within the casing 26. In particular, the door position sensor switch 98 signals, to the electronic circuit board 102, an indication of the position of the primary door 16, and the electronic circuit board 102 relays an indication of the position of the primary door 16 to the circuit board 86 contained in the casing 26 of the automated door closure system 10. In some embodiments, the remotely-mounted door position sensor 90 may also include a motion sensor or other similar sensor (not shown) to detect the presence of a user in the doorway, and the electronic circuit board 102 of the door position sensor 90 may also relay signals from the motion sensor to the circuit board 86 of the control unit 13.

Figure 5:
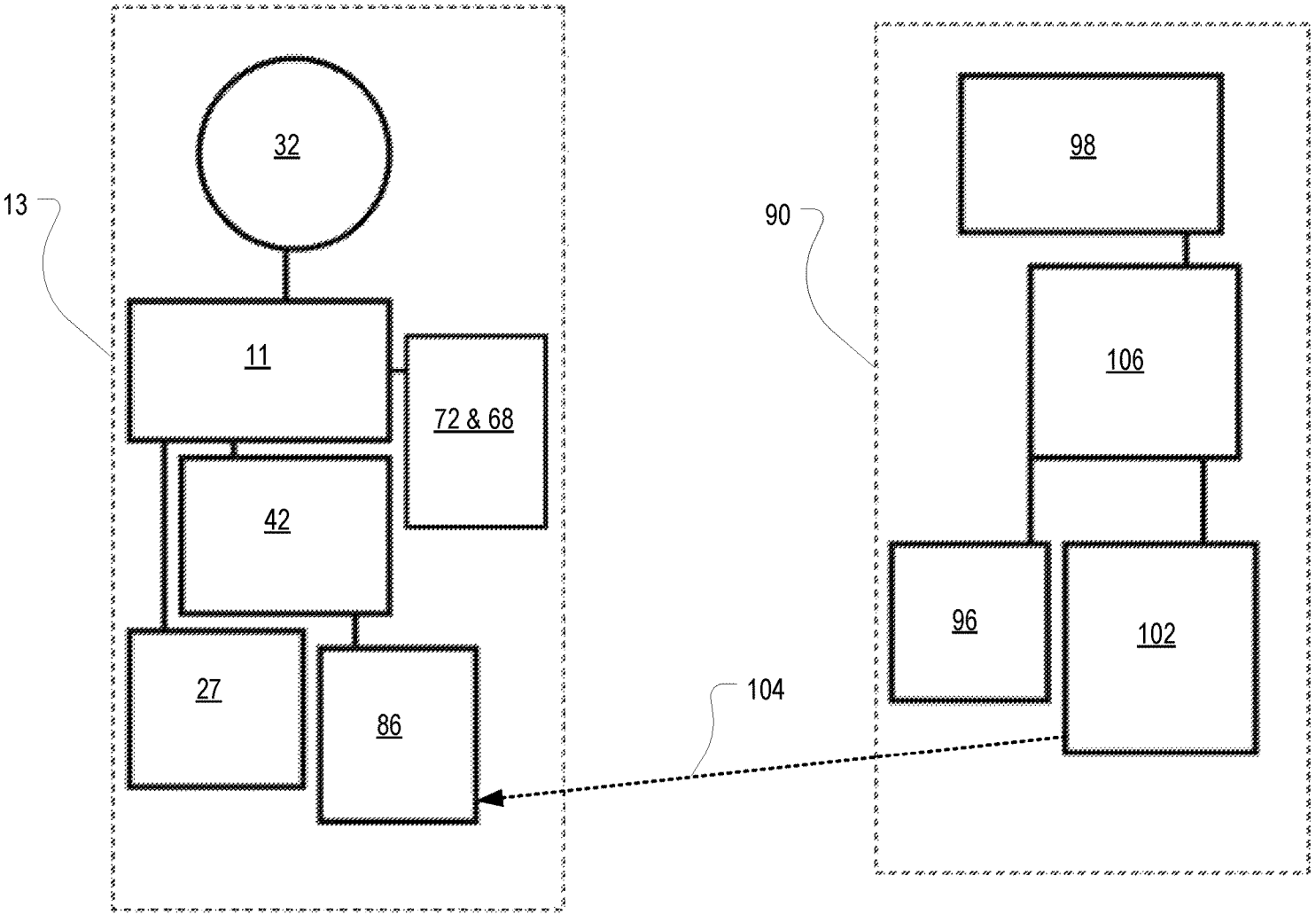
FIG. 5 is a schematic illustration of portions of the automated door closure system of FIG. 4 showing communication between the electronic circuit board of the remotely-mounted door position sensor and the circuit board of the control unit.

FIG. 5 is a schematic illustration of portions of the automated door closure system 10 of FIG. 4 showing communication between the electronic circuit board 102 of the remotely-mounted door position sensor 90 and the circuit board 86 of the control unit 13. In at least some embodiments, the electronic circuit board 102 of the remotely-mounted door position sensor 90 sends one or more wireless signals 104 to the circuit board 86 contained in the casing 26 of the automated secondary door closure system 10. As shown in FIG. 5, the remotely-mounted door position sensor 90 further includes a tone generator 106 to generate the wireless signals to the circuit board 86. In at least some alternative embodiments, the signals 104 are sent over a wired connection eliminating the need for the tone generator 106 and other wireless circuitry.

Alternatively, some or all of the mechanisms of the door closer 11 may be incorporated into the casing 26 of the automated door closure system 10 described here in below.

Figure 6:
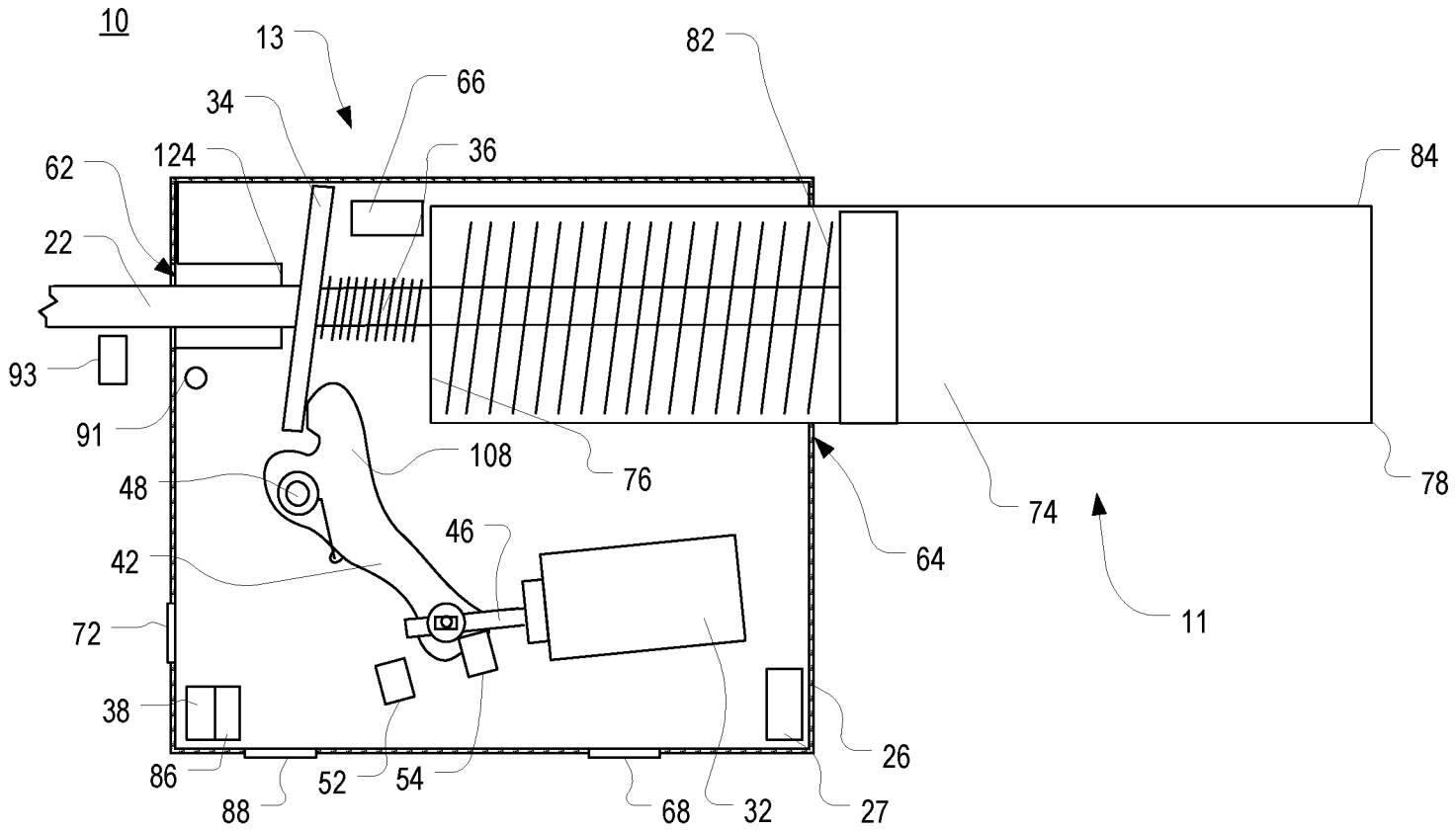
FIG. 6 is a front cross-sectional view of portions of the automated door closure system of FIG. 1, wherein the secondary door is in an open state.

FIG. 6 is a front cross-sectional view of portions of the automated door closure system 10 of FIG. 1, wherein the secondary door 12 is in an open state. As shown therein, when the door 12 is open, the main spring 82 (or compression hydraulic system) is compressed, urging the operating rod 22 attached to the piston head 84 toward the second end 76 of the cylinder 74. Movement of the operating rod 22 back into the cylinder 74 may be controlled by locking the operating rod 22 using the rod catch element 34. In particular, moving the rod catch element 34 from a generally perpendicular orientation, as shown in FIG. 3 (i.e., perpendicular in relation to lengthwise direction of the cylinder 74), to a non-perpendicular orientation, as shown in FIG. 6, stops the movement of the operating rod 22. On the other hand, when the rod catch element 34 is positioned in an orientation that is generally perpendicular orientation relative to the lengthwise direction of the cylinder 74, movement of the operating rod 22 can continue until the main spring 82 (or compression hydraulic system) is once again decompressed, as shown in FIG. 3. In at least some embodiments, the washer or other rod catch element 34 is generally flat with a thickness and hardness to stop the movement of the operating rod 22 and to thus hold the secondary door 12 open. In various embodiments, however, the rod catch element 34 may vary in shape, size, thickness, and hardness.

Figure 7:
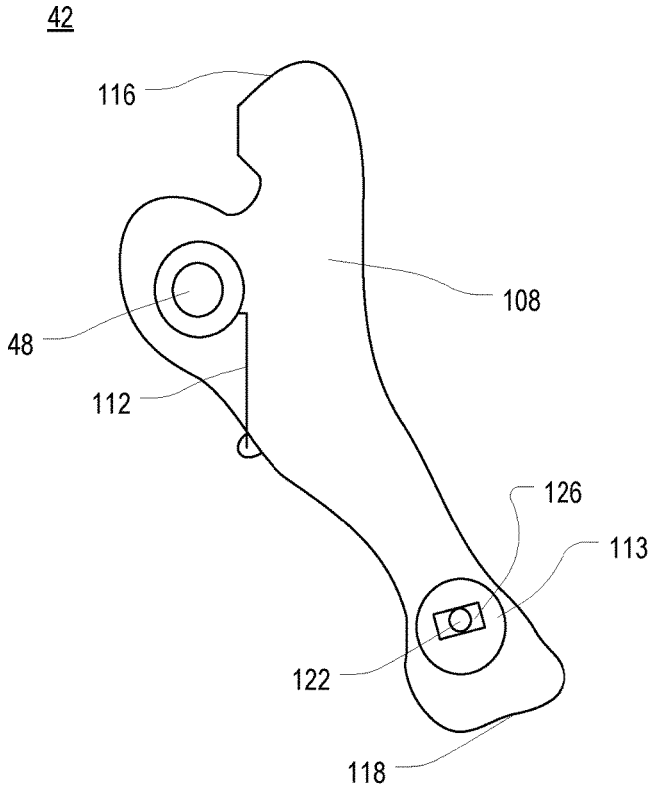
FIG. 7 is a front view of the cam assembly of the automated door closure system of FIG. 3.
Figure 8:
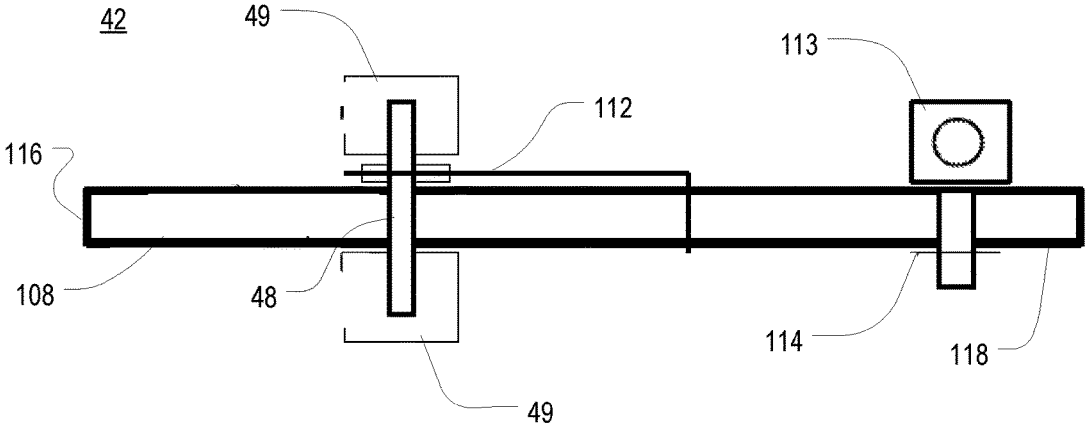
FIG. 8 is a top view of the cam assembly of the automated door closure system of FIG. 7.

FIG. 7 is a front view of the cam assembly 42 of the automated door closure system 10 of FIG. 3, and FIG. 8 is a top view of the cam assembly 42 of the automated door closure system 10 of FIG. 7. As shown in FIGS. 7 and 8, the cam assembly 42 includes a lever 108, a cam spring 112 that anchors into the lever 108, and a cam connector 113 that secures the shaft 46 of the motor 32 to the lever 108. The connector 48 passes through an opening to connect the lever 108 to the casing 26. The lever 108 includes a first end 116, a second end 118, and a rectangular slot 126. The rectangular slot 126 is cut into the lever 108 in which the cam connector 113 mounts. The rectangular slot 126 allows the lever 108 to rotate slightly against the force of the bias spring 112 while the connector 113 remains in a fixed position. FIG. 7 shows the end of the cam connector 122 passing through the slot 126 allowing rotation of the lever 108. In at least some embodiments, the cam assembly 42 is held on the cam connector 113 via a clip 114, which may be a semi-flexible metal ring with open ends that can be snapped into place, such as an E-clip or C-clip. The cam spring 112 loops over the connector 48 and hooks into the lever 108 to bias the notch on the first end 116 of the lever 108 away from the cylinder 74.

In operation, the door closer 11 and control unit 13 are connected to the secondary door 12 and frame 14 as shown in FIGS. 1 and 2. Referring to FIGS. 3 and 6, as the secondary door 12 is opened, the operating rod 22 is extended out of the cylinder 74 and casing 26. While the operating rod 22 extends, the movement of the rod catch element 34 is limited by the rod catch spring 36, the rod catch stop 66, the upper end of the lever 116 and the first opening 62. In at least some embodiments, the first opening 62 includes a guide edge 124 to further limit the movement of the rod catch element 34, as shown in FIGS. 3 and 6. As the secondary door 12 closes, the operating rod 22 retracts into the cylinder 74 and casing 26. When the control unit 13 is active, thus putting the unit in automated mode, the cam assembly 42 is in the reverse end position, as shown in FIG. 6, at all times except when the control unit 13 is releasing the operating rod 22 to let the door close. In this reverse end state, the top of the cam lever 116 is engaging the rod catch element 34 and tilting it into a locking position. When the secondary door 12 is opened, the operating rod 22 extends from the cylinder 74, overcoming the locking bias of the rod catch element 34. The top of the lever 108 moves towards the cylinder 74 within the distance allowed by the rectangular slot 126 in the lever 108 thus unlocking the rod catch element 34. When the door 12 begins to close and the operating rod 22 begins to contract into the cylinder 74, the rod catch element 34, which is locked onto the shaft, moves the lever 108, uses up the space in the rectangular slot 126 and the cam assembly 42 stops the movement of the rod catch element 34, which then stops the movement of the rod 22 holding the door in the open position.

To release the secondary door 12, the circuit board 86 activates the motor 32 to move the motor shaft 46 forward, which in turn rotates the lever 108 at the connector 48 until the cam connector 113 is stopped by the forward run limit switch 52. When the primary door 16 is in the open state, the primary door sensor 90 signals the circuit board 86 that the main door is open. When the secondary door 12 is in the open state, the magnet 93 on the operating rod 22 is removed from the reed switch 91, which in turn opens the reed switch. The open reed switch 91 relays to the circuit board 86 that the secondary door 12 is in the open state. When the primary door 16 is thereafter closed, the primary door sensor 90 signals to the circuit board 86 that the main door is closed. Meanwhile in at least some embodiments, the motion sensor 88 signals to the circuit board 86 whether motion (indicating the presence of a user) is detected in the doorway. With the primary door 16 closed, and no motion is detected in the doorway, the circuit board 86 in turn runs the motor 32 forward. The motor 32 stops when the second end of the lever 118 contacts the forward run limit switch 52. As the lever 108 rotates towards the cylinder 74, the rod catch element 34, which is locked onto the operating rod 22, moves with the rod 22 until it engages the rod catch stop 66. When the rod catch element 34 engages the stop 66, the stop 66 forces the rod catch element 34 into a perpendicular position relative to the operating rod 22 thus releasing the operating rod 22 to close the door.

In at least some embodiments, one or both of the remote door position sensor 90 and the control unit 13 are powered via wired connection, eliminating the need for the respective power sources 96,27.

To reset the automated door closure system 10, the circuit board 86 activates the motor 32 to move the motor shaft 46 backward, which in turn rotates the lever 108 at the connector 48 until the cam assembly 42 is stopped by the reverse run limit switch 54. When the primary door 16 is in the closed state, the primary door position sensor 90 signals the circuit board 86 that the primary door 16 is closed. When the secondary door 12 is in the closed state, the magnet 93 on the operating rod 22 actuates the reed switch 91, which allows the circuit board 86 to determine that the secondary door 12 is in the closed state, which in turn runs the motor 32. The motor 32 stops when the second end of the lever 108 contacts the reverse run limit switch 54. The rotated lever 108 in turn reengages the rod catch element 34. In at least some embodiments, one or both of the remote door position sensor 90 and the control unit 13 are powered via wired connection, eliminating the need for the respective power sources 96,27.

Figure 9:
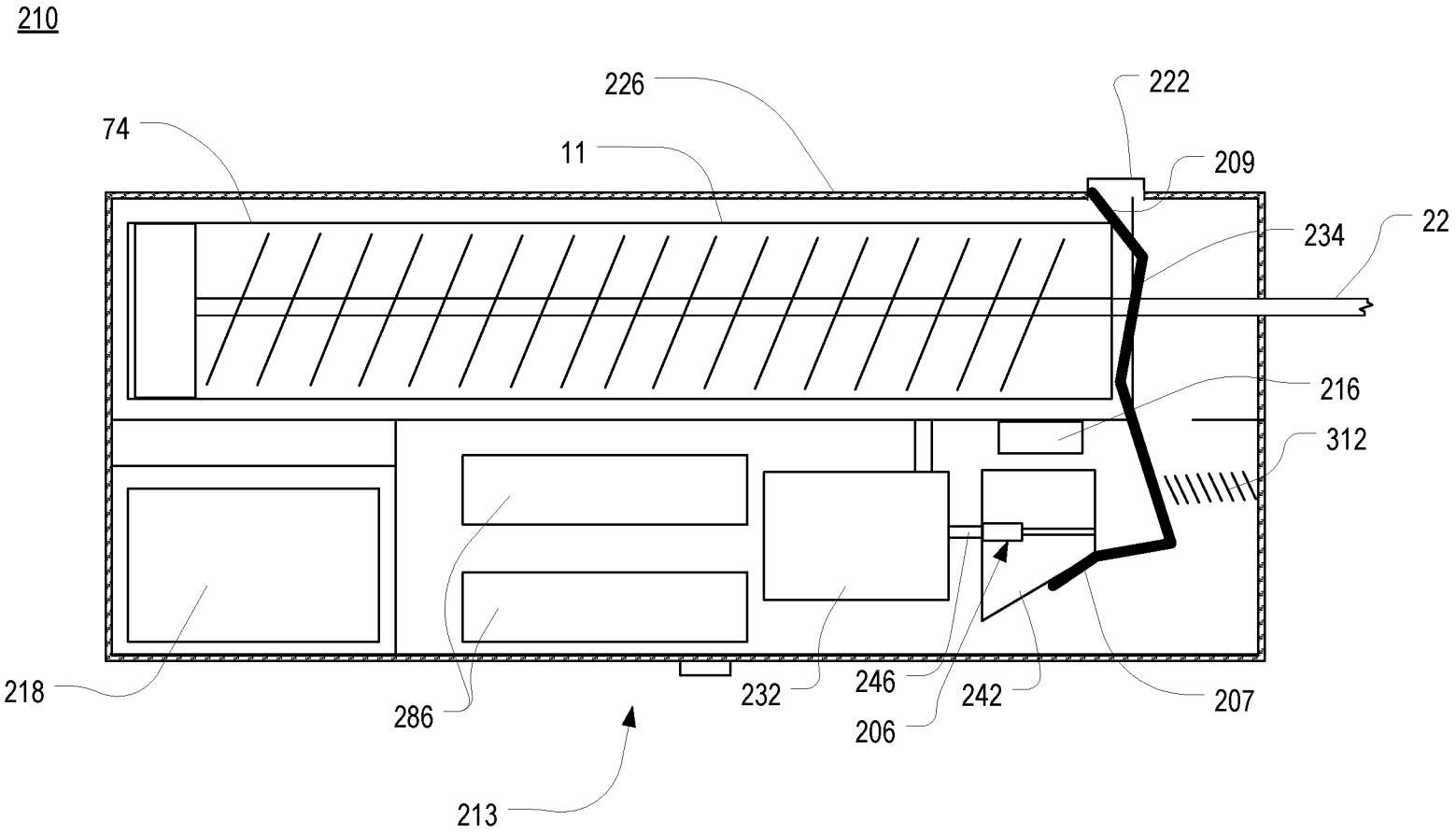
FIG. 9 is a front cross-sectional view of portions of an automated door closure system in accordance with one or more alternative embodiments of the present invention.

FIG. 9 is a front cross-sectional view of portions of an automated door closure system 210 in accordance with one or more alternative embodiments of the present invention. As shown therein, the alternative automated door closure system 210, which has many similarities to the system 10 of FIGS. 1-8, includes a door closer 11 and a control unit 213. In the illustrated embodiment, the sensor device is a remotely-mounted door position sensor 90. The door closer 11 is received in a casing 226 which also contains a motor 232, a motor shaft 246, a wedge 242 containing a damper mechanism 206, a rod catch element 234 held into position by a bias spring 312, a circuit board 286, a sensor unit 216, and a power source 218. These elements will be described in some detail hereinbelow.

The system 210 preferably also includes a sensor subsystem, including one or more sensor devices. Depending upon the implementation, such sensor devices may be physically incorporated in the control unit 213 or they may be physically separate from the control unit 213 but in communication with the control unit 213. Various sensor devices that may be utilized include position sensors, motion sensors, light sensors, and the like. One sensor device that may be provided is a remotely-mounted door position sensor, similar to the sensor 90 of the system 10 illustrated in FIGS. 1 and 2, that communicates information about the position of the primary door 16 to the control unit 213, and another sensor device that is provided is a motion sensor, similar to the sensor 88 of such system 10, that is incorporated into the control unit 213 and communicates information about the presence of a user in the doorway or movement of the secondary door 12, but it will be appreciated that other sensor devices may alternatively or additionally be utilized.

The rod catch element 234, which may, in various embodiments, be a locking key, a washer, or some other structure, is disposed adjacent the operating rod 22. In the illustrated embodiment, the rod catch element 234 is a locking key that, like a conventional locking key, is a hardened plate with two angled portions and a central aperture through which the rod 22 passes, but further includes a tail comprising one or more additional angled portions such as those illustrated herein. Like a conventional door closer locking key, the locking key 234 may be manipulated to prevent the rod 22 from moving relative to the locking key 34, such as by forcing the locking key 234 against the rod 22 so as to frictionally hold it in place. The locking key 234 can be manipulated using the wedge 242, which is operated by the motor 232 via the motor shaft 246. In particular, the motor shaft 246 is driven in or out by the motor 232 so as to push the wedge 242 out or pull it in.

The locking key 234 includes a first end 207 and a second end 209 and is generally rigid with a thickness and hardness to stop the movement of the operating rod 22 and to hold the secondary door 12 open, although in other embodiments the locking key 234 may vary in shape, size, thickness, and hardness. The casing 226 may include a notch 222 to allow extra room to accommodate end 209 of the locking key 234.

Figure 10:
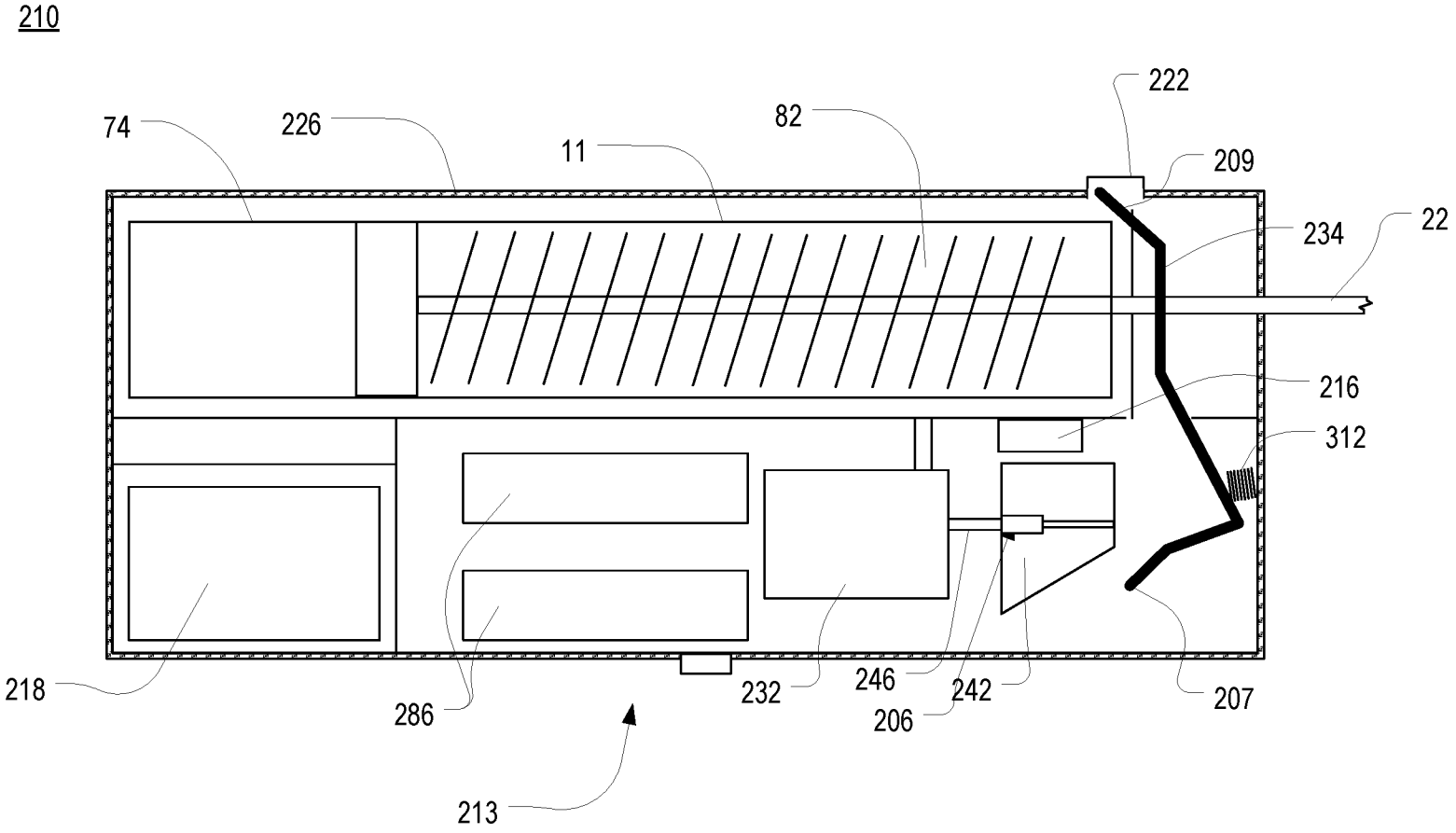
FIG. 10, which is a front cross-sectional view of the portions of the automated door closure system of FIG. 9, but shown with the door in a partially open state and the locking key in an unlocked position.

As shown in FIG. 9, when the operating rod 22 is fully withdrawn into the cylinder 74 (when the secondary door 12 is fully closed), the locking key 234 may be in its "locked" position. When the secondary door 12 is opened, force is applied to the operating rod 22, causing it to tend to pull out of the cylinder 74. With the second end 209 of the locking key 234 held generally in place, the locking key 234 rotates slightly into an orientation that is generally perpendicular relative to the operating rod 22, wherein the operating rod 22 can slide freely through the aperture of the locking key 234. This is shown in FIG. 10, which is a front cross-sectional view of the portions of the automated door closure system 210 of FIG. 9, but shown with the door 12 in a partially open state and the locking key 234 in an unlocked position. As shown therein, the locking key 234 is in a generally perpendicular orientation relative to the operating rod 22, and the operating rod 22 is partially withdrawn from the cylinder 74. The door 12 may thus be opened as much as desired (subject to the physical limits of the door 12 and the door closer 11).

Figure 11:
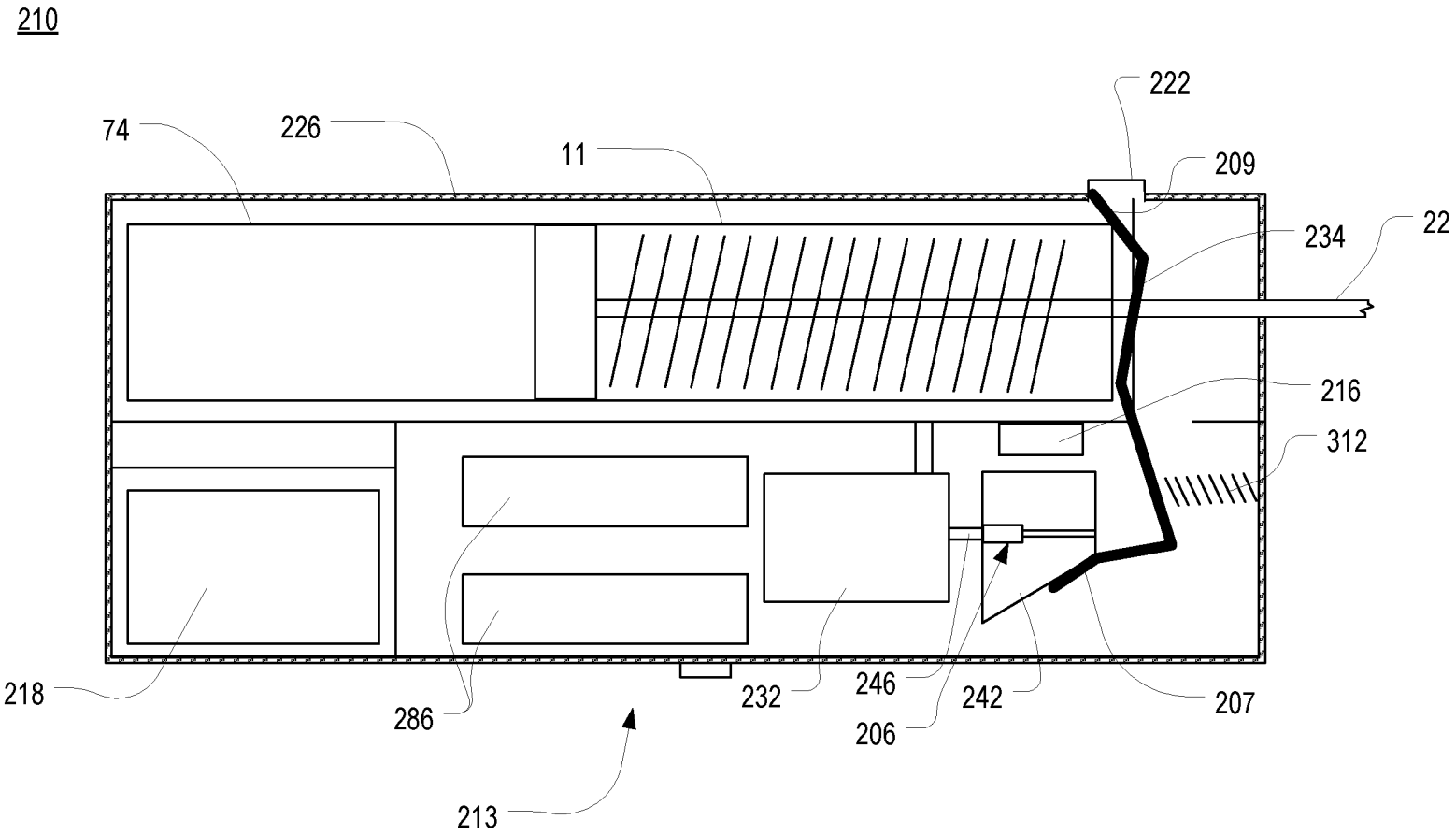
FIG. 11, which is a front cross-sectional view of the portions of the automated door closure system of FIG. 9, but shown with the door in a fully open state and the locking key in a locked position.

Once the door 12 is open, it is initially prevented from closing by the locking key 234. This is accomplished via the bias spring 312, which is compressed during opening of the door 12. The compressed spring 312 puts pressure on the locking key 234 causing the locking key 234 to rotate back to its locked position. This is illustrated in FIG. 11, which is a front cross-sectional view of the portions of the automated door closure system 210 of FIG. 9, but shown with the door 12 in a fully open state and the locking key 234 in a locked position.

Figure 12:
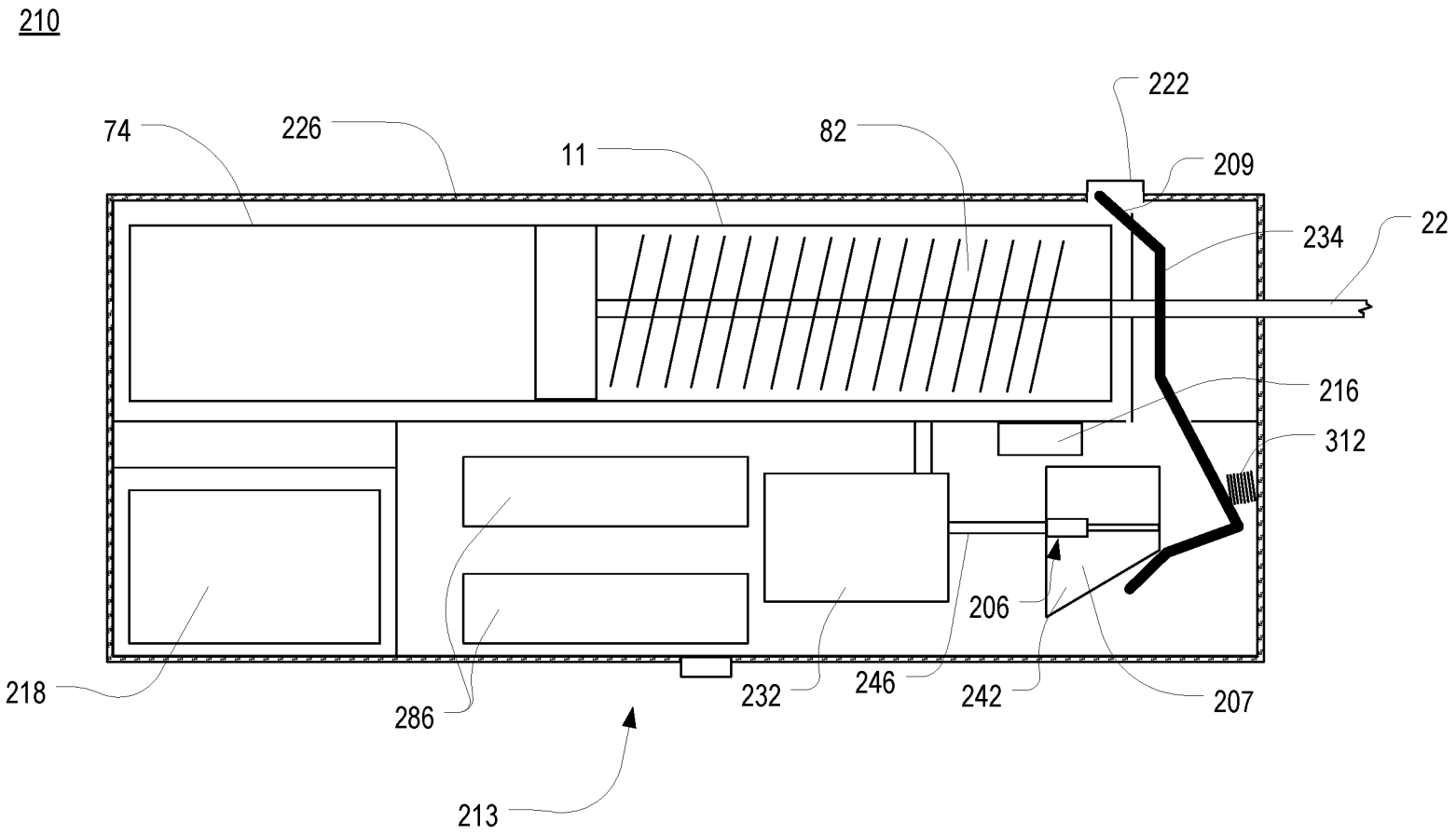
FIG. 12, which is a front cross-sectional view of the portions of the automated door closure system of FIG. 9, but shown with the door in a fully open state and the locking key in an unlocked position.

In at least some embodiments, when the door 12 is open, the locking key 234 remains in its locked position until released by the control unit 213. This is accomplished using the wedge 242, which is connected to the motor shaft 246 and moves back and forth with movement of the motor shaft 246. As the wedge 242 is forced outward (away from the motor 232), the wedge 242 engages the first locking key end 207. This forces the key 234 from its locked position, in which the locking key 234 prevents movement of the operating rod 22 into the cylinder 74, into its unlocked position (where the locking key 234 is generally perpendicular to the rod 22) in which the operating rod 22 is free to move relative to the locking key 234. This is illustrated in FIG. 12, which is a front cross-sectional view of the portions of the automated door closure system 210 of FIG. 9, but shown with the door 12 in a fully open state and the locking key 234 in an unlocked position. Because the locking key 234 does not prevent movement of the rod 22 into the cylinder 74, the door 12 may be closed. Once the door is fully closed, the locking key 234 may return to its locked position, as shown in FIG. 9.

Figure 13:
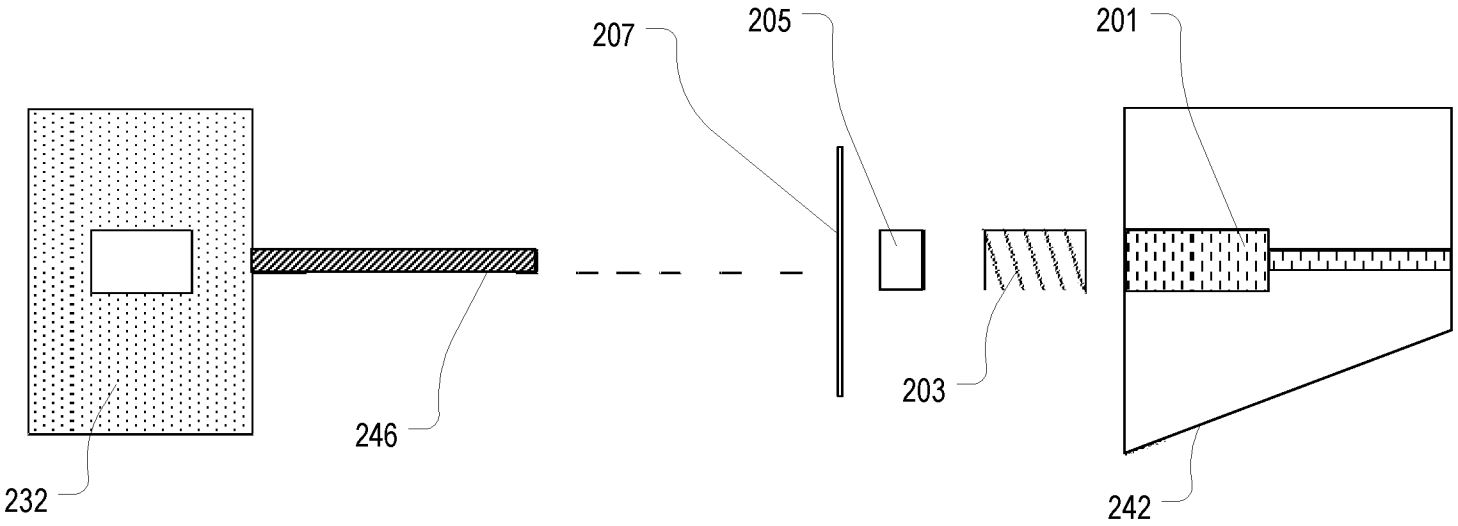
FIG. 13 is an exploded front cross-sectional view of portions of the automated door closure system of FIG. 9-12, illustrating the damper mechanism.

In another feature of various embodiments of the present invention, the damper mechanism 206 helps provide smoother operation. FIG. 13 is an exploded front cross-sectional view of portions of the automated door closure system 210 of FIG. 9-12, illustrating the damper mechanism 206. The damper mechanism 206 is generally internal to the wedge 242 and includes a threaded nut 205, into which the shaft 246 threads, a spring 203, and a retainer plate 204. The threaded nut 205, spring 203, and retainer plate 204 fit into the wedge 242 in the chamber 201. The nut 205 floats against the spring 203 but is prevented from turning by the chamber. The purpose of the damper mechanism 206 is to spring load the connection between the motor shaft 246 and the wedge 242 so the connection is not rigid. The non-rigid connection allows the wedge 242 to absorb the shock when the locking key 234 is released, thereby stopping a chattering effect.

In at least one mode, the automated door closure system 210 operates as follows. A user exerts force on the secondary door 12 to open it. The locking key 234 naturally rotates into the unlocked position, and the rod is allowed to move freely outward, thus permitting the door 12 to be opened. When the user releases the door 12, the bias spring 312 causes the locking key 234 to move back to its locked position, thereby holding the rod 22 in place and preventing the door 12 from closing. The locking key 234 remains in this position for a predetermined period of time. The control unit 213 may include a timer, utilizing the clock, for this purpose. In some embodiments this period of time may be measured from the time that the door 12 is released; in some embodiments this period of time may be measured from the time that motion in the doorway ceases; in some embodiments it is measured from the time the primary door 16 is closed; and in some embodiments a combination of such inputs is utilized.

In at least some modes of operation, the remote door position sensor relays a signal 104 to the circuit board 286 to indicate when the primary door 16 is closed, and the motion sensor 88 indicates to the circuit board 286 whether motion is detected in the doorway (thus indicating whether the user is still in the doorway or not). Once a predetermined period of time passes after the primary door 16 is closed and the last motion is detected, the circuit board 286 signals the motor 232 to run forward (outward). As the motor 232 runs forward, the damper mechanism 206, described above, allows the wedge 242 to jump forward slightly when the locking key 234 first releases. This forward jump prevents the locking key 234 from reengaging temporarily before the motor 232 places it in a perpendicular position. The motor 232 runs forward, moving the wedge 242 towards the locking key. As shown in FIG. 12, the locking key 234 is pushed into a perpendicular position, relative to the operating rod 22, which in turn releases the operating rod 22, thereby allowing the secondary door 12 to be closed using the force of the partially or fully compressed main spring 82 (or compression hydraulic system) of the closer unit 11. After the secondary door 12 closes, the sensor unit 216 relays to the circuit board 286 to run the motor 232 in reverse, thus moving the wedge 242 away from the locking key 234 and returning the locking key 234 to a locked position as shown in FIG. 9. The secondary door is now in the closed state, and thus the main spring 82 (or compression hydraulic system) in the cylinder is fully uncompressed. In at least some embodiments which include the remote door position sensor 90, the signals 104 are sent over a wired connection to the circuit board 286 eliminating the need for the tone generator 106 and other wireless circuitry described with respect to the embodiment illustrated in FIGS. 1-8. In at least some embodiments, one or both of the remote door position sensor 90 and the control unit 213 are powered via wired connection, eliminating the need for the respective power sources 96,27.

In at least some embodiments, the door closure systems 10,210 of the present invention may be marketed and sold as low cost, "do-it-yourself" products. As shown in FIGS. 1 and 2, such a door closure system 10 may be mounted on the secondary door 12 in the same location as an original standard door closer 11. In other words, an existing, conventional, door closer may be removed from a secondary door 12 and door frame 14 and replaced with a door closure system 10,210 of the present invention. In some embodiments, some or all of the mounting hardware used with the existing door closer could be reused to support a door closure system 10,210 of the present invention, in some cases without any adjustment. In embodiments where a primary door sensor 90 is used, the sensor 90 may be easily mounted on the door frame with two screws. Once batteries are installed, or once the system is plugged into to a power source, such as a standard residential electrical outlet, the system may be ready for use. In fact, in at least some embodiments, the door closure system 10 can be ready to use within ten minutes of unpacking its component parts.

Based on the foregoing information, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements; the present invention being limited only by the claims appended hereto and the equivalents thereof.

What is claimed is:

1. An automated door closure system to regulate the release and closure of a door in a door assembly, the door assembly including a primary door, a secondary door, and a door frame defining a doorway, the system comprising:

(a) a door closer connected between the secondary door and the door frame, the door closer including a cylinder having an operating rod extending from an end thereof, wherein the door closer biases the secondary door toward a closed position in the doorway;

(b) a control unit, including:

(i) a motive device, (ii) a rod catch element that releasably engages the operating rod, (iii) a mechanical linkage between the motive device and the rod catch element, wherein the mechanical linkage can be operated by the motive device to move the rod catch element from a first position to a second position, and (iv) a rod catch spring, (v) wherein, in the first position, the rod catch spring releasably biases the rod catch element, directly or indirectly, into engagement with the operating rod such that the rod catch element will allow a user to open the secondary door but will automatically latch onto the operating rod to prevent the secondary door from closing once it is released by a user, and, in the second position, the operating rod may move freely relative to the rod catch element such that the secondary door may be closed by the door closer, and (vi) wherein movement of the rod catch element, when latched onto the operating rod to prevent the secondary door from closing, to the second position can be effectuated by the motive device;

(c) at least one automatic input sensor, each sensor being arranged to detect a condition pertaining to the use of the door assembly;

(d) wherein the rod catch element is normally biased in the first position by the rod catch spring, including while the secondary door is being moved to an open position by a user and released, until such time as the condition is detected; and (e) wherein thereafter, the control unit controls operation of the motive device, based on the detected condition, to move the mechanical linkage to effectuate movement of the rod catch element from the first position to the second position, thereby permitting the door closer to close the secondary door.

2. The automated door closure system of claim 1, wherein the rod catch element, when latched onto the operating rod to prevent the secondary door from closing, is held in the first position by resting against an end of the mechanical linkage but can be moved from the first position to the second position when the mechanical linkage is moved by the motive device.

3. The automated door closure system of claim 1, wherein the at least one automatic input sensor includes a motion detector that detects motion in the vicinity of the doorway, and wherein the control unit controls operation of the motive device based on the detection of motion in the doorway.

4. The automated door closure system of claim 3, wherein the control unit controls the motive device to release the rod catch element from the operating rod a predetermined period of time after the most recent motion was detected in the doorway.

5. The automated door closure system of claim 3, wherein the motion detector is integrated into the control unit.

6. The automated door closure system of claim 3, wherein the motion detector is housed in a unit that is physically separate from the control unit.

7. The automated door closure system of claim 1, wherein the at least one automatic input sensor includes a door position sensor that detects the primary door closing in the doorway, and wherein the control unit controls operation of the motive device based on the detection of the primary door closing in the doorway.

8. The automated door closure system of claim 7, wherein the door position sensor is housed in a unit that is physically separate from the control unit.

9. The automated door closure system of claim 8, wherein the door position sensor communicates wirelessly with the control unit.

10. The automated door closure system of claim 8, wherein the door position sensor communicates via wired connection with the control unit.

11. The automated door closure system of claim 1, wherein the control unit includes a timer that delays operation of the motive device, to release the rod catch element, for a predetermined period of time after the at least one automatic input sensor detects the condition pertaining to the use of the door assembly, thus delaying the closing of the secondary door.

12. The automated door closure system of claim 11, wherein the at least one automatic input sensor includes a door position sensor that detects the primary door closing in the doorway, and wherein the control unit controls operation of the motive device, to release the rod catch element, for a predetermined period of time after the door position sensor detects the primary door closing, thus delaying the closing of the secondary door after the closing of the primary door.

13. The automated door closure system of claim 11, wherein the system further comprises circuitry, including the at least one automatic input sensor and one or more switch, that controls the motive device, wherein the circuitry, including the at least one automatic input sensor and the one or more switch, is configurable such that a user can adjust the amount of the predetermined period of time after the at least one automatic input sensor detects the condition pertaining to the use of the door assembly, thus controlling the amount of delay in the closing of the secondary door.

14. The automated door closure system of claim 1, further comprising circuitry that controls the motive device, wherein the circuitry is integrated into the control unit.

15. The automated door closure system of claim 1, further comprising circuitry that controls the motive device, wherein the circuitry is physically separate from the control unit.

16. The automated door closure system of claim 15, wherein the circuitry communicates via wired connection with the control unit.

17. The automated door closure system of claim 15, wherein the circuitry communicates via wireless connection with the control unit.

18. The automated door closure system of claim 1, further comprising circuitry that controls the motive device, wherein the circuitry includes controls to set the closure system to a manual mode wherein the rod catch can be adjusted manually by the user to hold the secondary door open or allow it to be biased closed by the door closer without regard to the detection or existence of the condition pertaining to the use of the door assembly.

19. The automated door closure system of claim 1, wherein the at least one automatic input sensor includes at least a first automatic input sensor and the detected condition is a first detected condition, wherein the at least one automatic input sensor further includes at least a second automatic input sensor that is arranged to detected a second condition relating to the use of the door assembly, and wherein, if the first condition is not detected after the secondary door is moved to an open position by a user and released, then the control unit controls operation of the motive device, based on the second detected condition, to move the mechanical linkage to effectuate movement of the rod catch element from the first position to the second position, thereby permitting the door closer to close the secondary door.

20. The automated door closure system of claim 1, wherein, when the control unit controls operation of the motive device, based on the detected condition, to move the mechanical linkage to effectuate movement of the rod catch element from the first position to the second position in order to permit the operating rod to move freely relative to the rod catch element such that the secondary door may be closed by the door closer, a portion of the rod catch element is initially moved toward the cylinder of the door closer to release tension placed on the rod catch element by the operating rod, and then the rod catch element is moved away from the operating rod in order to permit the operating rod to move freely relative to the rod catch element such that the secondary door may be closed by the door closer.

21. The automated door closure system of claim 1, wherein, when the control unit controls operation of the motive device, based on the detected condition, to move the rod catch element from the first position to the second position in order to permit the operating rod to move freely relative to the rod catch element such that the secondary door may be closed by the door closer, the operation of the motive device is controlled to initially move a portion of the rod catch element away from the cylinder of the door closer to release tension placed on the rod catch element by the operating rod.

* * * * *